US011209171B1

(12) United States Patent
Cowan

(10) Patent No.: US 11,209,171 B1
(45) Date of Patent: Dec. 28, 2021

(54) GAS BURNER LIGHTING VIA ROTATION

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 16/917,676

(22) Filed: Jun. 30, 2020

(51) Int. Cl.
*F24C 3/08* (2006.01)
*F24C 3/10* (2006.01)
*F23D 14/84* (2006.01)

(52) U.S. Cl.
CPC ..... *F24C 3/085* (2013.01); *F23D 14/84* (2013.01); *F24C 3/10* (2013.01); *F23D 2900/14005* (2013.01); *F23D 2900/14062* (2013.01)

(58) Field of Classification Search
CPC ..... F24C 3/085; F24C 3/10; F23D 14/84
USPC ..... 126/39 E, 39 H, 39 R; 431/191–194
See application file for complete search history.

(56) References Cited

U.S. PATENT DOCUMENTS

| | | | |
|---|---|---|---|
| 557,344 | A | 3/1896 | Shaw |
| 1,158,475 | A | 11/1915 | Fox |
| 1,163,807 | A | 12/1915 | Bower |
| 1,870,476 | A | 8/1932 | Babcock |
| 2,061,637 | A | 11/1936 | Schulz |
| 2,155,425 | A | 4/1939 | Mere |
| 2,327,512 | A | 8/1943 | Dennis |
| 2,491,324 | A | 12/1949 | Maki |
| 2,542,265 | A | 2/1951 | Staples |
| 2,591,072 | A | 4/1952 | Hughes |
| 2,646,788 | A | 7/1953 | Locke |
| 3,220,457 | A | 11/1965 | Bailey |
| 3,233,079 | A | 2/1966 | Wunderlin |
| 4,034,200 | A | 7/1977 | Visagie |
| 4,547,146 | A | 10/1985 | Tanaka et al. |
| 4,808,781 | A | 2/1989 | Liu |
| 4,938,687 | A | 7/1990 | Monteil |
| 5,059,755 | A | 10/1991 | Nottingham et al. |
| 5,077,460 | A | 12/1991 | Rocha et al. |
| 5,740,789 | A | 4/1998 | Chang |
| 6,017,211 | A | 1/2000 | Gort et al. |
| 6,107,615 | A | 8/2000 | Choi |
| 6,325,619 | B2 | 12/2001 | Dane |
| RE39,687 | E | 6/2007 | Choi |

(Continued)

FOREIGN PATENT DOCUMENTS

| | | |
|---|---|---|
| CN | 2070880 | 2/1991 |
| CN | 2199456 Y | 5/1995 |

(Continued)

OTHER PUBLICATIONS

International Search Report and Written Opinion issued in Application No. PCT/CN2018/074253 dated Aug. 3, 2018.

(Continued)

*Primary Examiner* — Vivek K Shirsat
(74) *Attorney, Agent, or Firm* — Middleton Reutlinger

(57) ABSTRACT

A method and apparatus for a gas burner head with at least a first burner region and a second burner region, an ignitor located near the gas burner, and a burner drive that is configured to generate relative rotation between the first and second burner regions of the gas burner to transfer a flame between the first and second burner regions during the relative rotation.

18 Claims, 5 Drawing Sheets

(56) References Cited

U.S. PATENT DOCUMENTS

| | | | | |
|---|---|---|---|---|
| 7,655,884 | B2 | 2/2010 | Engelhardt | |
| 7,901,205 | B2 | 3/2011 | Trochou | |
| 10,077,901 | B2 | 9/2018 | Herzog et al. | |
| 10,082,295 | B2 | 9/2018 | Zanetti et al. | |
| 10,228,144 | B2 | 3/2019 | Johncock et al. | |
| 10,281,145 | B2 | 5/2019 | Yang | |
| 2014/0231413 | A1 | 8/2014 | Zanetti et al. | |
| 2016/0334109 | A1 | 11/2016 | Krohn | |
| 2016/0348917 | A1 | 12/2016 | Johncock et al. | |
| 2017/0108215 | A1* | 4/2017 | Yang | F23D 14/26 |
| 2017/0108226 | A1 | 4/2017 | Moon et al. | |
| 2018/0106476 | A1 | 4/2018 | Breccia et al. | |
| 2018/0224120 | A1 | 8/2018 | Cheng et al. | |
| 2019/0056115 | A1 | 2/2019 | Cadima | |
| 2019/0120496 | A1 | 4/2019 | Paller | |
| 2019/0154265 | A1 | 5/2019 | Johncock et al. | |
| 2019/0186734 | A1* | 6/2019 | Cowan | F23D 14/84 |
| 2019/0186751 | A1 | 6/2019 | Cowan et al. | |

FOREIGN PATENT DOCUMENTS

| | | | |
|---|---|---|---|
| CN | 2665531 | Y | 12/2004 |
| CN | 200968636 | | 10/2007 |
| CN | 103175212 | A | 6/2013 |
| DE | 515602 | | 1/1931 |
| EP | 1725811 | | 11/2006 |
| EP | 2857752 | A1 | 4/2015 |
| FR | 2499220 | B1 | 6/1985 |
| GB | 776349 | A | 6/1957 |
| IN | 02717CH2013 | | 6/2016 |
| JP | 09229368 | A | 9/1997 |
| TW | 201038887 | A1 | 11/2010 |
| WO | 2014195067 | A1 | 12/2014 |
| WO | 2015054981 | A1 | 4/2015 |
| WO | 2019185341 | A1 | 10/2019 |

OTHER PUBLICATIONS

International Search Report and Written Opinion issued in Application No. PCT/CN2018/074175 dated Jul. 5, 2018.

U.S. Patent and Trademark Office, Non-Final Office Action issued in related U.S. Appl. No. 15/841,456 dated Sep. 20, 2019.

U.S. Patent and Trademark Office, Non-Final Office Action issued in U.S. Appl. No. 15/842,119 dated Dec. 18, 2019.

U.S. Patent and Trademark Office, Notice of Allowance issued in U.S. Appl. No. 15/841,456 dated Apr. 30, 2020.

U.S. Patent and Trademark Office, Notice of Allowance issued in U.S. Appl. No. 15/842,119 dated Jun. 17, 2020.

GE, GE Profile Ranges, Arizona Warehouse Supply, Retrieved on Mar. 30, 2020.

U.S. Patent and Trademark Office, Corrected Notice of Allowance issued in U.S. Appl. No. 15/841,456 dated Jul. 1, 2020.

* cited by examiner

GAS BURNER LIGHTING VIA ROTATION

BACKGROUND

In a cooking appliance such as a range or stovetop that utilizes gas burners, typical gas burner heads are fixed in position on a cooktop surface and do not rotate (e.g. they are stationary). Ignition of these conventional gas burners occurs generally via a user-initiated spark ignition; and the resulting initial flame must be transmitted from individual flame port to individual flame port to the entirety of the gas burner (e.g. around the periphery of the burner). For conventional dual or three-ring gas burners, the initial ignition of the burners occurs on one of the rings, generally the center ring. After ignition of the first ring, the flame must be transmitted to the other rings in order to ignite them. This transmission is traditionally accomplished by a carry-over feature, located between the rings, which allows the flame to travel from a first ring to second (and/or third) ring.

It has been found, however, that the crossover between the rings of a multi-ring burner may be slow and/or inconsistent. Conventionally, the gas flowing from the target port of the cross-over channel must come in contact with a specific flame on a first ring in order to be ignited. The cross-over channel must then further ignite the rest of the cross-over-flame system before igniting a second ring. This transfer from one ring to another may be affected by ambient conditions, wind, and pressure differences in the gas, any of which may affect the efficiency of this transition.

Therefore, a significant need continues to exist in the art for a manner of lighting gas burners in order to improve in the speed and consistency of lighting.

SUMMARY

The herein-described embodiments address these and other problems associated with the art by providing a cooktop appliance capable of generating relative rotation between different components of a gas burner in order to ignite different regions of the burner. For example, in an aspect, the cooktop appliance described herein includes: a gas burner including at least a first burner region and a second burner region; an ignitor disposed proximate the gas burner and configured to ignite one of the first and second burner regions; and a burner drive configured to generate relative rotation between the first and second burner regions of the gas burner to transfer a flame between the first and second burner regions during the relative rotation.

In some embodiments, the gas burner includes a first ring, a second ring, and a cross-over channel configured to communicate a flame between the first ring and the second ring. In such embodiments, the first burner region may be on the first ring and the second burner region may be on the second ring. In other such embodiments, the gas burner may further include a third burner region disposed on one of the first and second rings. In some embodiments, the gas burner may further include a plurality of burner regions on the second ring.

In some embodiments, the burner drive is configured to generate the relative rotation by rotating the first burner region relative to the second burner region. In other embodiments, the burner drive is configured to generate the relative rotation by rotating both of the first and the second burner regions. In such instances, the burner drive may be configured to generate the relative rotation by rotating the first burner region in a first rotational direction and the second burner region in a second rotational direction. In still other embodiments, the burner drive is configured to generate the relative rotation by rotating only one of the first burner region and the second burner region.

In some embodiments, the first and second burner regions each include one or more flame ports. In some such embodiments, the one or more flame ports of the second burner region are disposed on an outer periphery of the gas burner.

In some embodiments, the burner drive is configured to rotate the one of the first and second burner regions of the gas burner ignited by the ignitor, and wherein the ignitor is stationary.

In another aspect, a cooktop appliance described herein includes: a gas burner including at least a first ring, a second ring, and a cross-over channel configured to communicate a flame between the first ring and the second ring; where the first ring includes at least one burner region, and where the second ring includes at least one burner region; an ignitor disposed proximate the gas burner; and a burner drive configured to generate relative rotation between the first ring and the second ring to ignite gas emitted in each of the first and second of burner regions.

In some embodiments, the burner drive is configured to generate the relative rotation by rotating the first ring and the second ring. In some such embodiments, the burner drive is configured to generate the relative rotation by rotating the first burner region in a first rotational direction and the second burner region in a second rotational direction.

In some embodiments, the at least one burner region of the second ring includes a first burner region, a second burner region, a third burner region, and a fourth burner region.

In some embodiments, the first ring includes one or more flame ports disposed on an outer periphery of the first ring and the second ring includes one or more flame ports disposed on an outer periphery of the second ring. In some such embodiments, the relative rotation between the first ring and the second ring allows the cross-over channel to ignite one or more flame ports disposed on one of the first and second rings.

In some embodiments, the burner drive is configured to generate the relative rotation by rotating only one of the first ring and the second ring.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

FIG. 3A illustrates an initial ignition of the first ring the gas burner. FIG. 3B illustrates the ignition of the cross-over channel of the gas burner. FIG. 3C illustrates complete ignition of the gas burner.

FIG. 5A illustrates an initial ignition of the first ring of the gas burner. FIG. 5B illustrates the ignition of the cross-over channel of the gas burner. FIG. 4C illustrates complete ignition of the gas burner.

DETAILED DESCRIPTION

Figure 1:
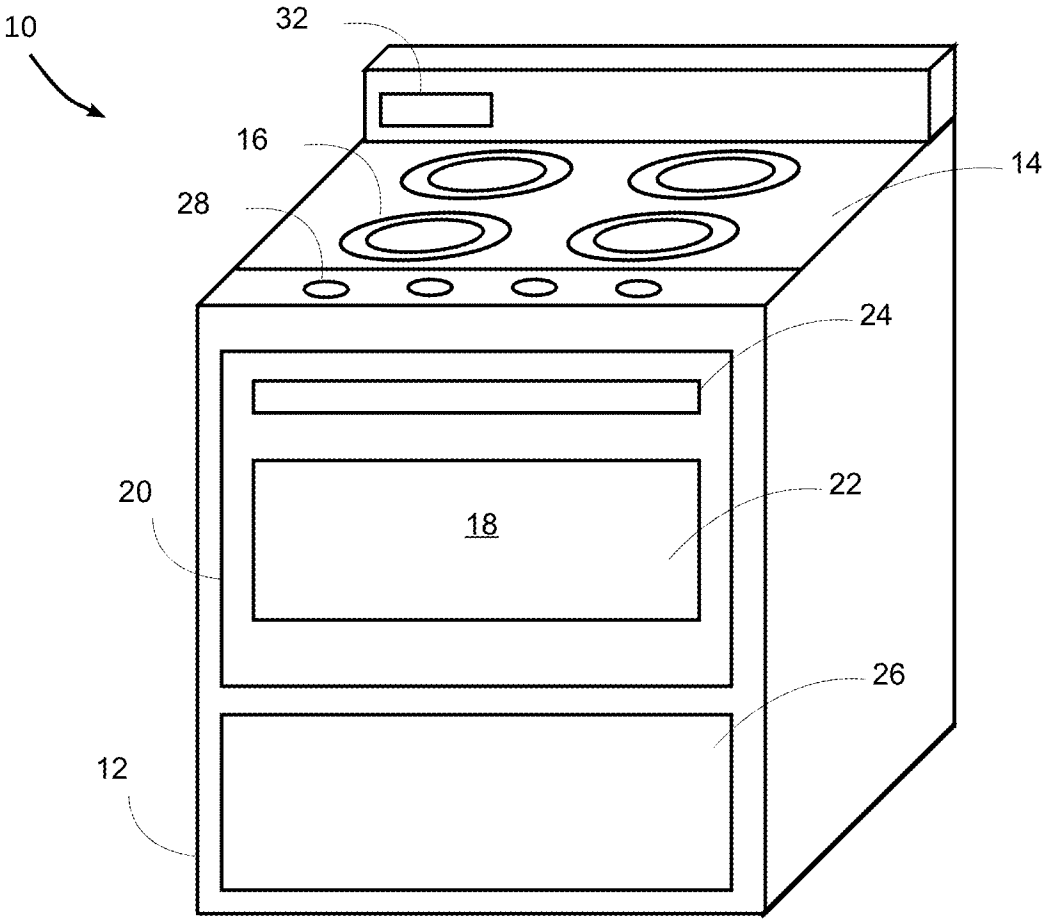
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of gas burners 16, and an oven 18 defining a cooking cavity accessed via an oven door 20 having a window 22 and a handle 24. Cooking appliance 10 may also include a storage drawer 26 in some embodiments, or in other embodiments, may include a second oven.

Cooking appliance 10 may also include various manually-actuated user control devices, including, for example, control knobs 28 for controlling burners 16. It will be appreciated that cooking appliance 10 may include various types of manually-actuated control devices in other embodiments, including various combinations of switches, buttons, knobs and/or sliders, typically disposed at the rear or front (or both) of the cooking appliance. These control knobs 28 may control the gas burners 16. In some instances, other characteristics of the gas burner (e.g. burner(s) rotational direction (clockwise and/or counterclockwise), speed of rotation of one or more gas burner heads and/or burners within, degree of rotation, continuous rotation and/or intermittent rotation in one or more directions, idler gears, motor, and/or selection of gas burner head and/or burner portions to rotate or non-rotate, etc.) may be controlled by a separate control device. Cooking appliance 10 may further include a display 32 for a timer, clock, and/or the like. Display 32 may also vary in different embodiments, and may include individual indicators, segmented alphanumeric displays, and/or dot matrix displays, and may be based on various types of display technologies, including LEDs, vacuum fluorescent displays, incandescent lights, etc.

As noted above, cooking appliance 10 of FIG. 1 is a range, which combines both a stovetop or cooktop and one or more ovens, and which in some embodiments may be a standalone or drop-in type of range. In other embodiments, however, cooking appliance 10 may be another type of cooking appliance, e.g., a drop-in stovetop or cooktop, etc. In general, a cooking appliance consistent with the invention may be considered to include any residential-type appliance including a housing and one or more gas cooking elements disposed thereon and/or therein and configured to generate energy for cooking food.

Figure 2:
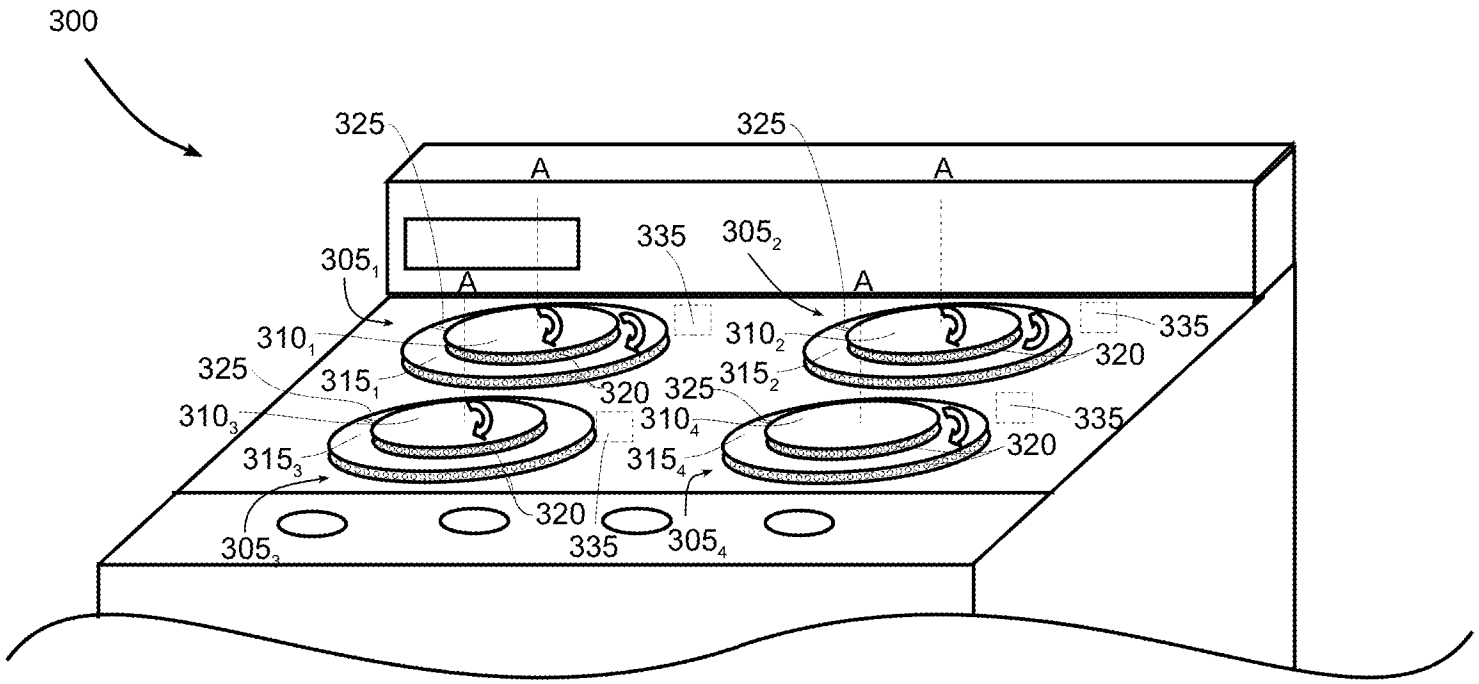
FIG. 2 is a partial perspective view of a cooking appliance with a two-ring burner consistent with some embodiments of the invention.

Referring now to FIG. 2, this figure illustrates a perspective view of an embodiment of a cooking appliance 300. As illustrated, the cooking appliance 300 includes a plurality of gas burners $\mathbf{305}_{1\text{-}n}$, burner drives 335, and igniters (see 330 in FIG. 3). In the illustrated embodiment, each of the each gas burners $\mathbf{305}_{1\text{-}n}$ includes a first ring $\mathbf{310}_{1\text{-}n}$ and a second ring $\mathbf{315}_{1\text{-}n}$, each of which may include one or more flame ports 320. Although these flame ports 320 are shown to be positioned at their respective outer periphery of each ring $\mathbf{310}_{1\text{-}n}$, $\mathbf{315}_{1\text{-}n}$, the flame ports 320 may be in a variety of positions, etc. (e.g. on the top surface with radial spaced ports in linear pattern, increase or decrease in density on the top surface of the burner towards the outer periphery, circumferential or spiral pattern on the top surface of the burner, etc.). One or more gas flow channels, in fluid communication with the gas supply (not shown), may be upstream from and in fluid communication with the flame ports 320. The one or more gas flow channels may be defined by a variety of structures (e.g. a gear mechanism, one or more burners, injector cup, and/or cap, etc.). One or more gas valves (not shown) may be used to control the amount of gas flow provided to the gas burner $\mathbf{305}_{1\text{-}n}$ and/or the first and second rings $\mathbf{310}_{1\text{-}n}$, $\mathbf{315}_{1\text{-}n}$, and a user may control the amount of gas supply to the burner ports by adjusting this valve(s), for example through use of a control knob.

In the illustrated embodiments, rotation of one or both of the first and second rings $\mathbf{310}_{1\text{-}n}$, $\mathbf{315}_{1\text{-}n}$ may be used to facilitate lighting of multiple regions of a gas burner. In some instances, the first ring $\mathbf{310}_{1\text{-}n}$ may define a first burner region and the second ring $\mathbf{315}_{1\text{-}n}$ may define a second burner region. In other instances, the first ring and/or second ring may also each have a plurality of burner regions (see regions 1-4 in FIGS. 4 and 5A-C). In some instances, a burner drive 335 may rotate the gas burners $\mathbf{315}_{1\text{-}n}$ about one or more axes A. This burner drive 335 may include a motor and a drive gear that may engage gear teeth on the periphery the gas burner. In other embodiments, the drive gear may directly engage the gas burner. It should be understood that the burner drive 335 be a variety of constructions, quantities, sizes, shapes, etc. and still be within the scope of the present invention. In some instances, there may be a separate burner drive for each gas burner and/or for each ring; in other instances, there may be a central burner drive that powers the rotation of all the gas burners.

As shown in one embodiment, the first ring $\mathbf{310}_1$ and the second ring $\mathbf{315}_1$ of a gas burner $\mathbf{305}_1$ may rotate about the same central axis A. In some instances, the first ring $\mathbf{310}_1$ and the second ring $\mathbf{315}_1$ may both rotate in the same rotational direction. In other instances, the rotational direction may be clockwise (as illustrated with reference to the first ring $\mathbf{310}_1$ and the second ring $\mathbf{315}_1$); while in other instances, this rotational direction may be counter-clockwise. In another embodiment, the first ring $\mathbf{310}_2$ and the second ring $\mathbf{315}_2$ may rotate in a first rotational direction and an opposing second rotational direction, respectively (e.g. FIGS. 3A-C and FIGS. 5A-D).

In some instances, the first and second rings 310, 315 may be capable of rotating in multiple directions; for example, the burner drive 335 may be able to reverse directions. In some instances, the first ring $\mathbf{310}_{1\text{-}n}$ and the second ring $\mathbf{315}_{1\text{-}n}$ may rotate at the same time and speed; however this is not intended to be limiting as the first ring $\mathbf{310}_{1\text{-}n}$ and the second ring $\mathbf{315}_{1\text{-}n}$ do not necessarily have to rotate at the same time and/or at the same rate or speed.

In other embodiments, one of the first ring $\mathbf{310}_{1\text{-}n}$ or the second ring $\mathbf{315}_{1\text{-}n}$ burners may rotate while the other is fixed, i.e., does not rotate. For example, in one embodiment, the first ring $\mathbf{310}_3$ may rotate, while the second ring $\mathbf{315}_3$ remains fixed. In another exemplary embodiment, the second ring $\mathbf{315}_4$ may rotate, while the first ring $\mathbf{310}_4$ remains fixed. In some instances, one or more burner caps (not illustrated) may also be disposed over the first and/or second rings $310_{1-n}$, $315_{1-n}$ of the gas burner $305_{1-n}$. These burner caps, where present may, in some instances, be rotationally fixed or stationary.

The rotation of the first ring $310_{1-n}$ and/or the second ring $315_{1-n}$ of a gas burner $305_{1-n}$ facilitates lighting of different rings or regions of the burners $305_{1-n}$ (see FIGS. 3A-C, 4, and 5A-D). The ignitor 330 to light a portion of the flame ports 320, and the rotation of the first ring $310_{1-n}$ and/or the second ring $315_{1-n}$ allows the flame to be quickly transmitted to different regions and/or rings as the first ring $310_{1-n}$ and/or the second ring $315_{1-n}$ rotate. The relative rotation of the two regions (in this instance, the first ring $310_{1-n}$ and/or the second ring $315_{1-n}$) may improve the consistency and speed of ignition of a gas burner $305_{1-n}$.

There may be one or more cross-over flame channels 325 disposed between the first ring $310_{1-n}$ and the second ring $315_{1-n}$ of the gas burner; this cross-over flame channel 325 may facilitate movement of the ignited gas between the first ring $310_{1-n}$ and the second ring $315_{1-n}$ by igniting flame ports of each ring as they sweep past the cross-over channel while rotating. In some instances, this cross-over flame channel 325 may be a covered cross-over that is disposed underneath a burner cap, if present. In other instances, the cross-over channel 325 may be an exposed cross-over that may be visible to a user. As a non-limiting example, after the first ring $310_{1-n}$ ignites, the rotation allows the flames extending from the flame ports 320 sweep across the cross-over channel 325, allowing ignition of the cross-over channel. The cross-over channel 325 may then ignite the second ring $315_{1-n}$. In some embodiments, multiple cross-over flame channels may be used.

Figure 3B:
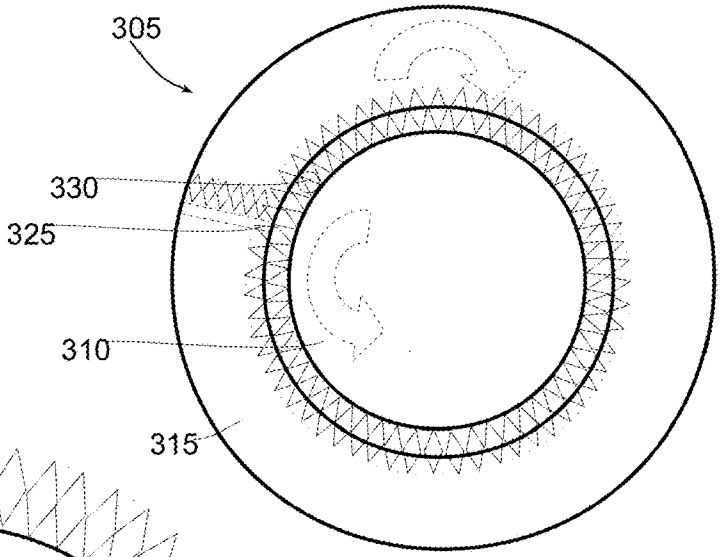
FIG. 3A-C are a sequence of top views of the gas burner of FIG. 2 illustrating the rotation of the gas burner consistent with some embodiments of the invention.
Figure 3C:
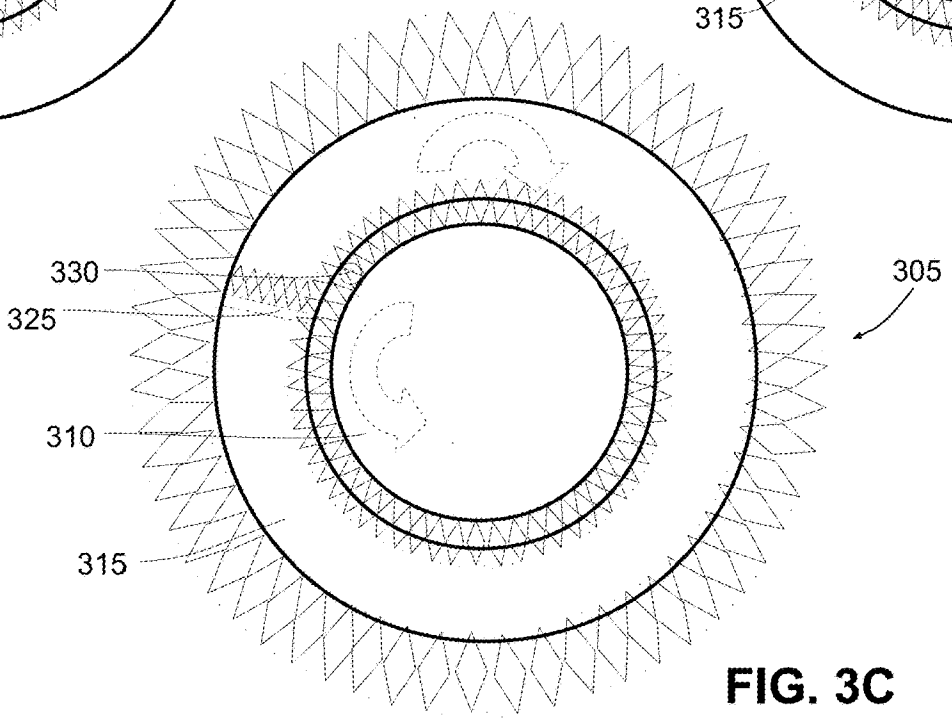
Figure 3A:
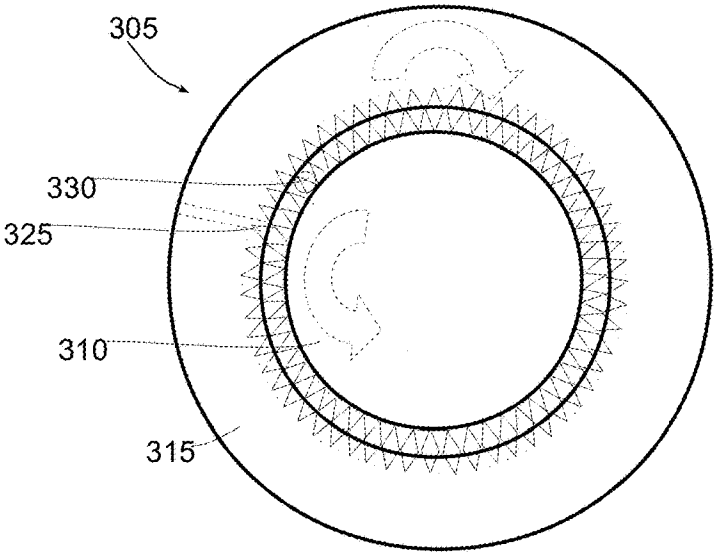

Referring now to FIGS. 3A-C, these figures illustrate a top view of a multi-ring gas burner 305 in sequence in order to illustrate the ignition and rotation of the gas burner 305. In some instances, such as illustrated in FIGS. 3A-C, each of the first ring 310 and a second ring 315 may include multiple burner regions. For example, the first ring 310 may be a first region, and the second ring 315 may be a second region. An ignitor 330 may ignite a portion of the flame ports 320 of the first ring 310 proximate the ignitor 330. As illustrated in FIG. 3A, after the ignitor ignites a portion of the flame ports (see 320 in FIG. 2), the fire will propagate to the remaining flame ports of the first ring 310. By rotating the first ring 310, the flames of the first ring may communicate a flame to the cross-over channel 325, as illustrated in FIG. 3B. In some instances, the second ring 315 may be stationary or fixed. In such instances, the flame from the ignited cross-over channel 325 may be communicated to the second ring 315 and then propagated around the second ring automatically. In other instances, such as illustrated in FIG. 3C, the communication of the flame from the ignited cross-over channel 325 to the second ring 315 may be facilitated by the rotation of the second ring 315. This may allow multiple attempts for a flame of the ignited cross-over channel to ignite the second ring 325 as it rotates. Once ignited, the remainder of the flame ports of second ring 315 may be propagated traditionally.

As illustrated in FIGS. 3A-C, the rotation of the first ring 310 as illustrated by the arrow in broken lines allows the flame to be communicated from an ignited first ring 310 to the cross-over channel 325. In some instances, such as illustrated by the arrow in broken line, the rotation of the second ring 315 may additionally facilitate communication of the ignited cross-over channel 325 to the second ring 315. The direction of rotation is not limiting, and may be either clockwise, counter-clockwise, or reversible between the two. It will also be appreciated that due to the relative movement between the rings, the alignment of the cross-over channel to a flame of the first ring is not as critical, thereby facilitating ignition of the cross-over channel and thus the second ring irrespective of varying operating conditions, e.g., due to variances in ambient conditions, wind, and/or gas pressure.

Figure 4:
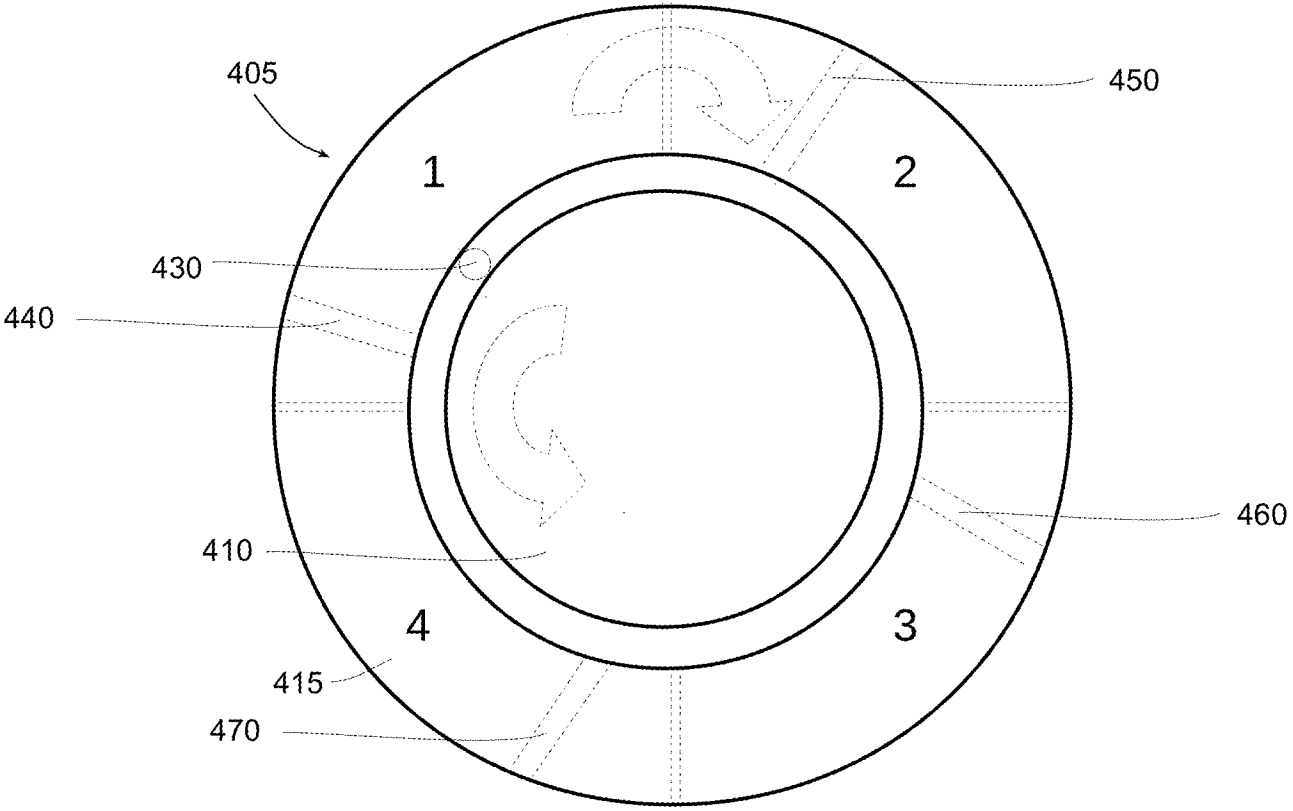
FIG. 4 is a top view of an embodiment of another gas burner consistent with some embodiments of the invention.

Referring now to FIG. 4, this figure illustrates a top view of another embodiment of a gas burner 405. In some instances, such as illustrated in FIG. 4, the gas burner 405 may include first ring 410 and a second ring 415, and the second ring 415 may include multiple burner regions (e.g. regions 1, 2, 3, and 4). Although illustrated as including four regions, this is not to be understood as limiting, the number of regions on the second ring 415 may vary; as a non-limiting example, the second ring 415 may have two, three, five or more regions. The regions of FIG. 4 are physically separated, for example by a gap in flame ports or a physical divider. In some instances, this gap may facilitate separate lighting of each region. Furthermore, each region may have a cross-over channel 440, 450, 460, 470 (for reach of regions 1, 2, 3, and 4, respectively). The rotation of the first ring 410 (as illustrated by the arrows in broken lines) allows the flame to be quickly and efficiently communicated and ignite each of the cross-over channels 440, 450, 460, 470, which will be described in greater detail with reference to FIGS. 5A-C.

Figure 5B:
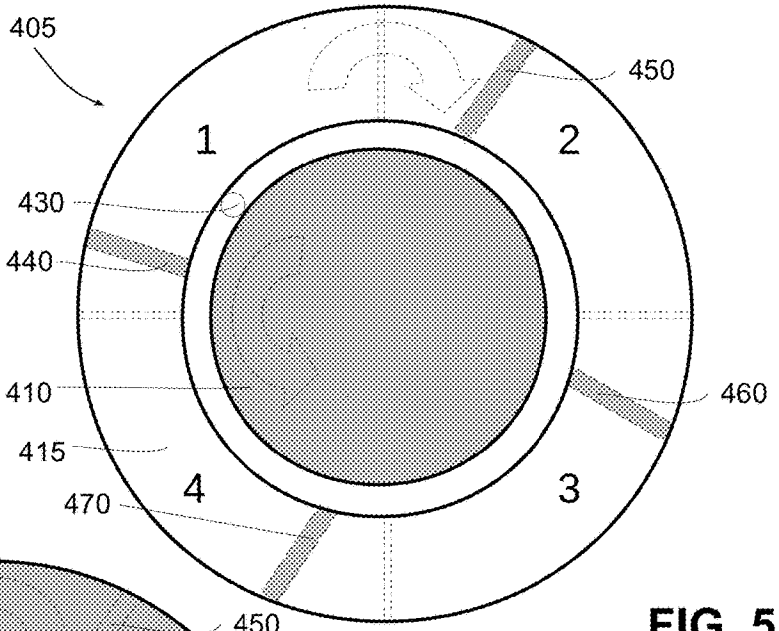
FIG. 5A-C are a sequence of top views of the gas burner of FIG. 4 illustrating the rotation of the gas burner consistent with some embodiments of the invention.
Figure 5A:
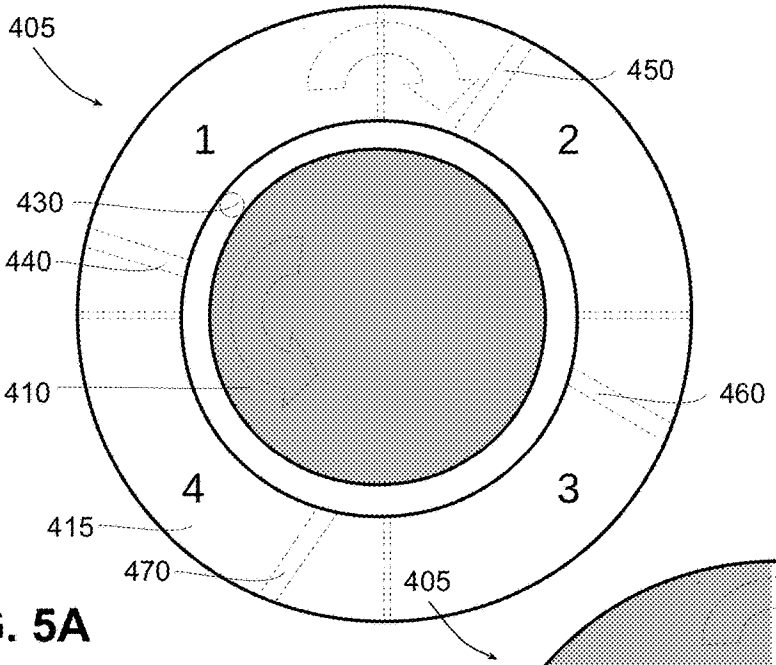
Figure 5C:
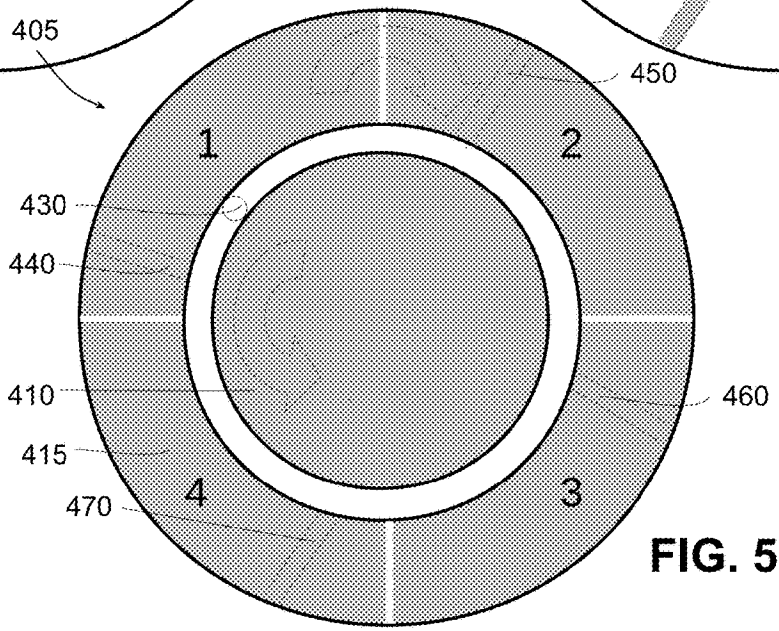

FIGS. 5A-C illustrate a multi-ring gas burner 405 in sequence in order to illustrate the ignition and rotation of the gas burner 405. FIG. 5A illustrates when the ignitor 430 sparks, after which, the ignitor 430 may ignite a portion of the flame ports of the first ring 410 proximate the ignitor 430. As illustrated in FIG. 5A, the flame will propagate to the remaining flame ports of the first ring 410, as illustrated by the shading in FIG. 5A. As illustrated in FIG. 5B, the rotation of the first ring 410 allows the flames of the first ring 410 to be communicated to the cross-over channels 440, 450, 460, 470 (as indicated by the shading in FIG. 5B).

In some instances, the second ring 415 may be stationary or fixed. In such instances, the flame from each of the ignited cross-over channels 440, 450, 460, 470 may be communicated to each of the regions (1, 2, 3, and 4). In other instances, such as illustrated in FIG. 5C, the communication of the flame from the ignited cross-over channels 440, 450, 460, 470 to each region (1, 2, 3, and 4) of the second ring 415 may be facilitated by the rotation of the second ring 415. This rotation may allow multiple attempts for a flame of the ignited cross-over channel to ignite flame ports disposed in each region (1, 2, 3, and 4) of the second ring 415 as it rotates. Once ignited, the remainder of the flame ports of each region (1, 2, 3, and 4) second ring 415 will be propagated (as indicated by the shading in FIG. 5C).

It will be appreciated that various modifications may be made to the embodiments discussed herein, and that a number of the concepts disclosed herein may be used in combination with one another or may be used separately.

The invention claimed is:

1. A cooktop appliance comprising:

a gas burner including at least a first burner region and a second burner region;

an ignitor disposed proximate the gas burner and configured to ignite one of the first and second burner regions; and a burner drive configured to generate relative rotation between the first and second burner regions of the gas burner to transfer a flame between the first and second burner regions during the relative rotation;

wherein the gas burner includes a first ring, a second ring, and a cross-over channel configured to communicate a flame between the first ring and the second ring, wherein the first burner region is disposed on the first ring and the second region is disposed on the second ring, wherein the first burner region includes a plurality of flame ports, and wherein the burner drive is configured to generate relative rotation between the first and second burner regions of the gas burner such that the cross-over channel sweeps past the plurality of flame ports during the relative rotation to transfer the flame between at least one of the plurality of flame ports and the cross-over channel during the relative rotation.

2. The cooktop appliance of claim 1, wherein the cross-over channel is a first cross-over channel and the gas burner further includes a second cross-over channel, wherein the relative rotation further generates relative rotation between the second cross-over channel and the plurality of flame ports to sweep the second cross-over channel past the plurality of flame ports.

3. The cooktop appliance of claim 1, wherein the gas burner further includes a third burner region disposed on one of the first and second rings.

4. The cooktop appliance of claim 3, wherein the gas burner further includes a plurality of burner regions on the second ring.

5. The cooktop appliance of claim 1, wherein the burner drive is configured to generate the relative rotation by rotating the first burner region relative to the second burner region.

6. The cooktop appliance of claim 1, wherein the burner drive is configured to generate the relative rotation by rotating both of the first and the second burner regions.

7. The cooktop appliance of claim 6, wherein the burner drive is configured to generate the relative rotation by rotating the first burner region in a first rotational direction and the second burner region in a second rotational direction.

8. The cooktop appliance of claim 1, wherein the burner drive is configured to generate the relative rotation by rotating only one of the first burner region and the second burner region.

9. The cooktop appliance of claim 1, wherein the second burner region includes a second plurality of flame ports.

10. The cooktop appliance of claim 9, wherein the second plurality of flame ports of the second burner region are disposed on an outer periphery of the gas burner.

11. The cooktop appliance of claim 1, wherein the burner drive is configured to rotate the one of the first and second burner regions of the gas burner ignited by the ignitor, and wherein the ignitor is stationary.

12. A cooktop appliance comprising:

a gas burner including at least a first ring, a second ring, and a cross-over channel configured to communicate a flame between the first ring and the second ring, wherein the first ring includes a plurality of flame ports;

an ignitor disposed proximate the gas burner; and a burner drive configured to generate relative rotation between the cross-over channel and the plurality of flame ports to sweep the cross-over channel past the plurality of flame ports to ignite gas emitted in each of the first and second burner rings.

13. The cooktop appliance of claim 12, wherein the burner drive is configured to generate the relative rotation by rotating the first ring and the second ring.

14. The cooktop appliance of claim 13, wherein the burner drive is configured to generate the relative rotation by rotating the first ring in a first rotational direction and the second ring in a second rotational direction.

15. The cooktop appliance of claim 12, wherein the second ring includes a first burner region, a second burner region, a third burner region, and a fourth burner region.

16. The cooktop appliance of claim 12, wherein the plurality of flame ports are disposed on an outer periphery of the first ring and the second ring includes one or more flame ports disposed on an outer periphery of the second ring.

17. The cooktop appliance of claim 12, wherein the cross-over channel is a first cross-over channel and wherein the gas burner further includes a second cross-over channel, wherein the relative rotation further generates relative rotation between the second cross-over channel and the plurality of flame ports to sweep the second cross-over channel past the plurality of flame ports.

18. The cooktop appliance of claim 12, wherein the burner drive is configured to generate the relative rotation by rotating only one of the first ring and the second ring.

* * * * *